US005109914A

United States Patent [19]

Kidd et al.

[11] Patent Number: 5,109,914

[45] Date of Patent: May 5, 1992

[54] INJECTION NOZZLE FOR CASTING METAL ALLOYS WITH LOW MELTING TEMPERATURES

[75] Inventors: Thomas F. Kidd, Toledo, Ohio; Stephen A. Thompson, St. Bruno; Guiseppe Paduano, Montreal, both of Canada

[73] Assignee: Electrovert Ltd., Laprairie, Canada

[21] Appl. No.: 578,835

[22] Filed: Sep. 4, 1990

[51] Int. Cl.[5] ..... B22D 37/00

[52] U.S. Cl. ..... 164/113; 141/354; 164/337; 164/133

[58] Field of Search ..... 164/133, 136, 337, 119, 164/306, 113; 141/346, 351, 352, 354, 357

[56] References Cited

U.S. PATENT DOCUMENTS 1,634,482 7/1927 Youtsey ..... 164/119
3,934,626 1/1976 Hall ..... 164/337

FOREIGN PATENT DOCUMENTS 403167 6/1966 Switzerland ..... 164/337
1171183 8/1985 U.S.S.R. ..... 164/337
2044162 10/1980 United Kingdom ..... 164/337

*Primary Examiner*—Kuang Y. Lin
*Attorney, Agent, or Firm*—Darby & Darby

[57] ABSTRACT

In the casting of metal alloys with low melting temperatures, there is provided a nozzle for an interface connection between a transfer line and a die which permits misalignment and a variable height differential. Meal alloys with low melting temperatures are made for cores in subsequently molded plastic components and for encapsulating components for machining the other finishing steps. The nozzle has a base with a valve therein, a nozzle body adapted to move relative to the base to open the valve, and a spring to hold the valve closed. A sleeve joins the nozzle body and the base, and a connector on the nozzle body provides an interface connection between the transfer line and the die so that when the connector interfaces with the die, the valve is open.

21 Claims, 4 Drawing Sheets

INJECTION NOZZLE FOR CASTING METAL ALLOYS WITH LOW MELTING TEMPERATURES

BACKGROUND OF THE INVENTION

The present invention relates to the casting of metal alloys with low melting temperatures, and more specifically to a nozzle for providing an interface connection from a transfer line to a die.

Low temperature melt out metal parts of complex shapes are made for use as cores in subsequently molded plastic components, and other embodiments, metal alloys with low melting temperatures are used for encapsulating components, such as turbine blades, so they may be held for machining and other finishing steps. After use, the metal from the cores or encapsulations is remelted and reused.

To ensure that a uniform density and fine grain structure for castings and encapsulations is achieved, it is necessary to cast the material under low pressures quite different from that of a die casting process. Metal alloys with low melting temperatures cannot be used in the die casting process. Air holes and cavities are formed in these alloys when die cast and this results in imperfect castings being produced. In die casting, shot pressures are generally in the range of 800 to 4,000 lbs per sq. inch and the time for injection is in the order of 30 to 40 milliseconds. In such an operation where hot metals are injected at a high velocity and with turbulent flow into a die through a narrow gate, air can become entrapped and pressures build up in the cylinder and passage to the die. These high speed injection processors generally include runners leading into the die, and the unsolidified metal drains back after the casting process.

Melt out metal parts are made wherein the melting temperature of the metal alloys is generally below 350° C. High pressure die casting is not appropriate for making melt out metal parts or encapsulations because the desired dimension tolerances cannot be achieved. Castings of melt out metal alloys are generally produced by allowing liquid metal alloy to flow into a die under substantially no pressure. After the die is full, a small pressure, generally in the order of 30 to 50 lbs per sq. inch is built up in the die during the cooling stage. The filling and cooling time can vary from about 3 to 30 seconds depending upon the size of the casting.

One example of an apparatus for casting metal alloys with low melting temperatures is disclosed in U.S. patent application Ser. No. 268,492 filed Nov. 8, 1988. An improved valve mechanism for casting metal alloys with low melting temperatures is also disclosed in U.S. application Ser. No. 520,213 filed May 7, 1990.

Liquid metal alloy flows from a cylinder in a liquid metal alloy tank, through a transfer line outside the tank, and into a die through a nozzle which interfaces with the die. After the casting, the die is removed from the nozzle, cooled and then opened to remove the casting. In certain types of casting machines, where multiple injection points are required on the die or dies, a manifold is supplied with a number of nozzles on the manifold fed from a single supply source of liquid metal alloy. Difficulties can occur due to nozzles or dies having slightly different dimensions. This can result in liquid metal alloy spillage at the interface between the nozzle and the die. Another problem that can exist is misalignment between the die and the nozzle and this too can result in spillage of liquid metal alloy.

A further problem that can exist is that when the die is separated from the nozzle. Frozen metal alloy sometimes extends into the nozzle which causes difficulties in separating the die from the nozzle. There is thus a need to resolve these problems.

SUMMARY OF THE INVENTION

It is an aim of the present invention to provide a nozzle interface for casting liquid metal alloys having low temperatures, the interface is between the transfer line and the die and takes into account lateral and direct misalignment with regards to height. The nozzle interface can tolerate a higher degree of misalignment with regards to the position of the nozzle relative to the die both laterally and directly. Furthermore, it is an aim of the present invention to provide a nozzle for a transfer line from a liquid metal alloy supply which has a valve therein so that the liquid metal flow is stopped except when the die interfaces with the nozzle.

Furthermore, the nozzle deflects when the die and nozzle are interfaced. In most cases this occurs by bringing the die down onto the nozzle. The nozzle can be compressed and takes care of differences of die positioning for different dies. No gap is permitted between nozzle and die because this is taken up by the deflection of the nozzle assembly. The nozzle also acts as a shut off valve for liquid metal alloy within the nozzle to avoid spillage. By shutting off the liquid metal alloy, the risks of frozen metal alloy extending from the die into the nozzle when the die and the nozzle are separated, is reduced. The valve in the nozzle assembly also assists in preventing solder freezing and sticking to the die. By permitting the nozzle to be deflected when the die and nozzle interface, different dies having variations in vertical entry positions may be interfaced with a single nozzle. Thus, there is no need to change the nozzle for different entry positions.

The present invention provides in an apparatus for casting metal alloys with low melting temperatures, the improvement of a nozzle in a transfer line for joining to a die, comprising a base for connection to the transfer line, valve means in the base to open and close the nozzle, nozzle body associated with the valve means, adapted to move relative to the base, and having spring means to retain the valve means closed, sleeve means joining the base and the nozzle body to provide a passage for liquid metal alloy therethrough, and connector positioned on the nozzle body to provide an interface connection between the transfer line and the die adapted to open the valve means when the connector interfaces with the die.

The present invention also provides in a method of casting metal alloys with low melting temperatures, wherein liquid metal alloy flows through a transfer line into a removable die, the improvement comprising the steps of: feeding liquid metal alloy to a nozzle having valve means therein, the valve means being closed when the nozzle does not interface with the die, and arranging for the nozzle and the die to interface, the valve means opening when the nozzle interfaces with the die.

BRIEF DESCRIPTION OF THE DRAWINGS

In drawings which illustrate embodiments of the present invention.

DETAILED DESCRIPTION OF THE INVENTION

Figure 1:
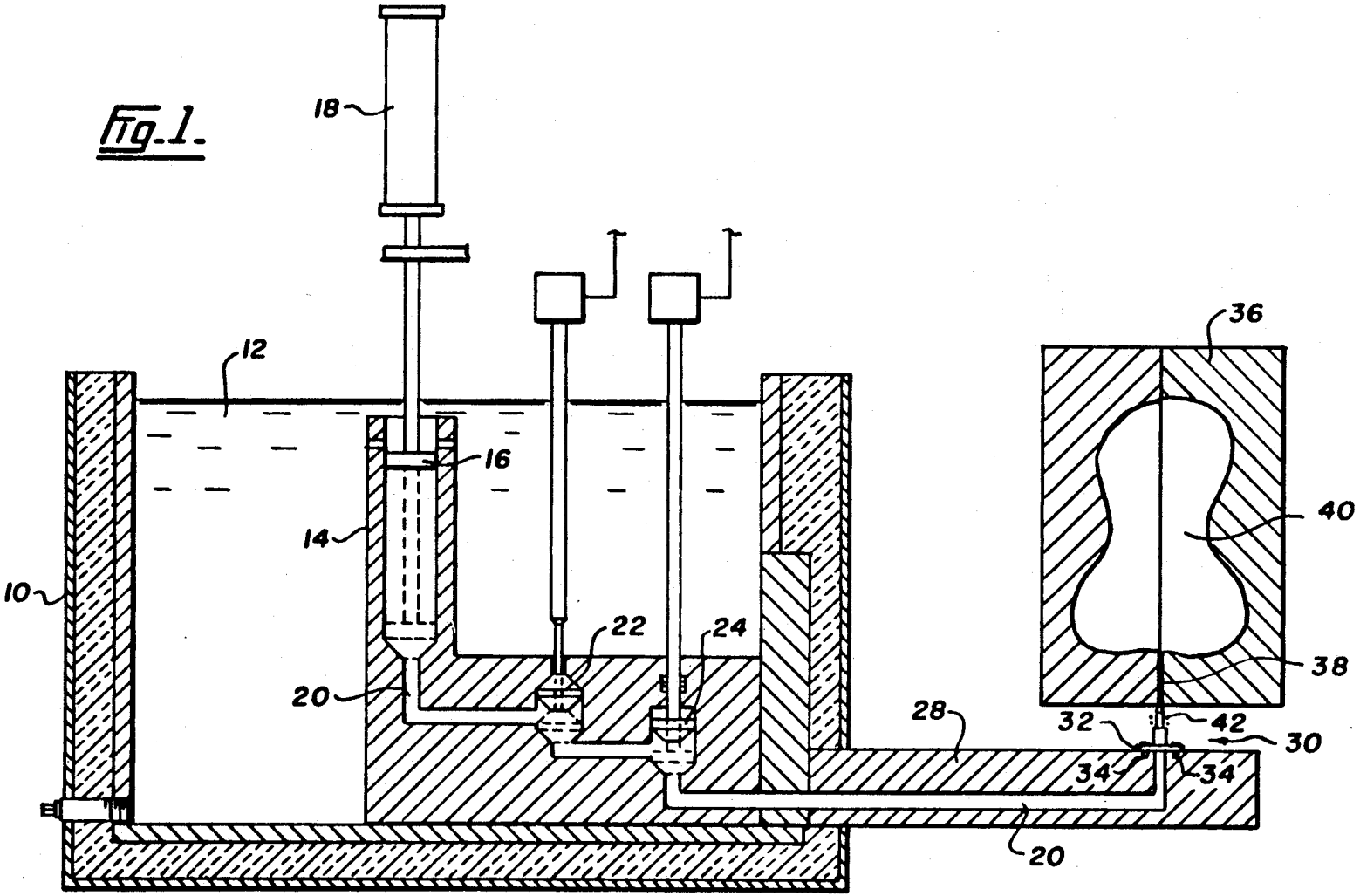
FIG. 1 is a schematic diagram depicting an apparatus for casting metal alloys with low melting temperatures wherein the metal alloy passes along a transfer line through a nozzle into a die.

FIG. 1 illustrates a tank 10 with molten metal alloy 12 therein. A cylinder 14 in the tank 10, has a piston 16 operated by a pneumatic or hydraulic cylinder 18 which permits liquid metal alloy to flow through a transfer line 20 passed two valves 22 and 24 into a transfer line manifold 28 outside the tank 10. The operation of the piston 16 in the cylinder 14 is described in our previous patent applications.

A nozzle assembly 30 has a flange 32 permitting bolts 34 to hold the assembly 30 onto the manifold 28 positioned above the transfer line 20. A die 36 is arranged to sit on the nozzle assembly 30 and has a connection 38 from the nozzle assembly 30 directly into a casting area 40. In the embodiment shown, electrical heating coils 42 surround top of the nozzle assembly 30 to ensure that the liquid metal alloy at the top is kept warm at all times to avoid any liquid metal alloy from freezing.

Figure 2:
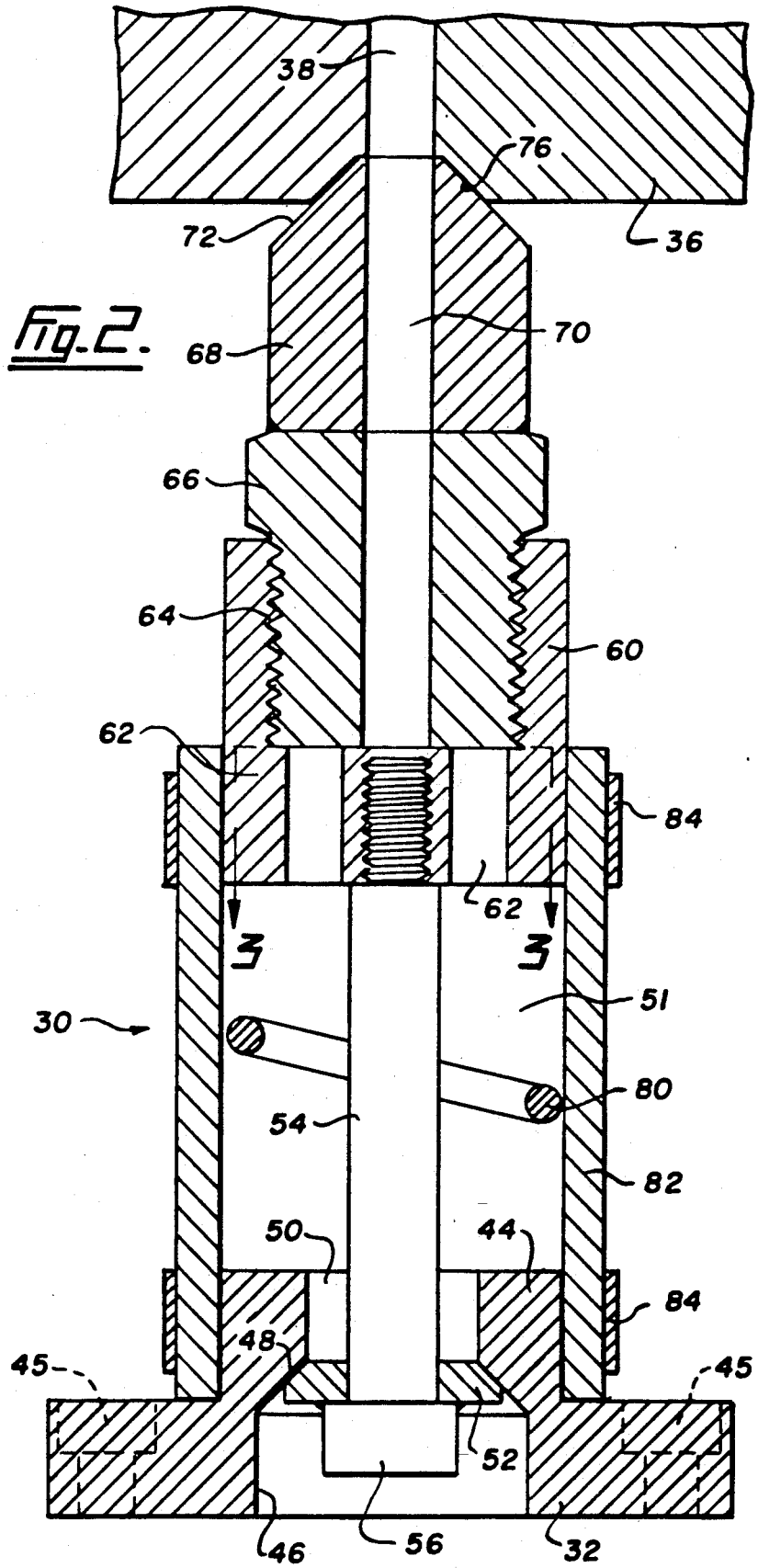
FIG. 2 is a sectional view showing a nozzle according to one embodiment of the present invention.

One embodiment of a nozzle assembly 30 is shown in FIG. 2. A base 44 extending from the flange 32 has holes 45 for bolts 34 as shown in FIG. 1. A concentric aperture 46 in the base 44 extends to a tapered shoulder 48 and a smaller diameter aperture 50 concentric with the aperture 46 extends into an interior space 51. A valve member 52 has a tapered valve seat to engage the tapered shoulder 48 in the base 44. The valve member 52 is welded to a valve stem 54 having a head 56 to provide a shoulder for support. When the valve member 52 is seated on the tapered shoulder 48, the valve is closed, and no metal alloy can flow through the transfer nozzle.

Figure 3:
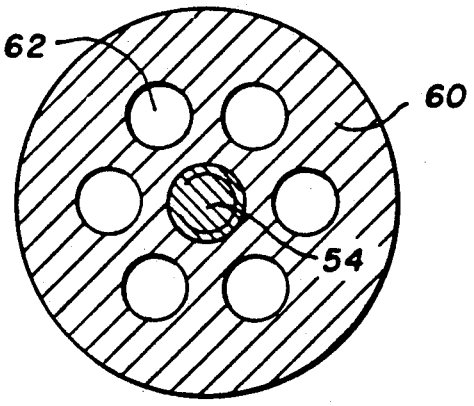
FIG. 3 is a sectional view taken at line 3—3 of FIG. 2.

A nozzle body 60 is securely attached to the top of the valve stem 54 thus movement of the nozzle body 60 relative to the base 44 opens or closes the valve. The nozzle body 60 is disk shaped with a plurality of apertures 62 in a circle about the stem 54 as shown in FIG. 3. The apertures 62 permit the flow of liquid metal alloy from the interior space 51. The nozzle body 60 has an internal threaded portion 64 extending upwards from the disk portion and an adapter 66 is threaded into the threaded portion 64 to sit squarely on the disk portion of the nozzle body 60. The adapter 66 is joined by a welded connection to an interface connector 68, and both have a concentric passage 70 which terminates at a tapered tip 72 of the interface connector 68 to permit liquid metal alloy to pass into the die 36. The die 36 has a tapered shoulder 76 to mate with the nozzle tip 72 and the connection 38 passes to the casting area 40 of the die 36.

A coiled spring 80 surrounds the stem 54 in the interior space 51 and holds the nozzle body 60 and the base 44 apart. In the apart position the valve is closed and no liquid metal alloy can pass therethrough. A sleeve 82 extends from the base 44 to the nozzle body 60. The sleeve 82 is flexible and is able to withstand the temperatures of liquid metal alloy passing therethrough. In one embodiment the sleeve 82 is formed of a high temperature silicone rubber hose. Clamps 84 are shown clamping the sleeve 82 to both the base 44 and the nozzle body 60. The sleeve 82 is sufficiently flexible to allow the nozzle body to move inwards when compressed thus opening the valve. No metal alloy can escape from the ends of the sleeve 82 where it is joined to the nozzle body 60 or the base 44.

Whereas the sleeve 82 is shown and described as being of flexible material, and capable of being compressed, other types of sleeve, such as a telescoping sleeve made of tubes, one of which slides within the other may be used. Alternatively, a section of the tube may be of a stainless steel bellows type configuration permitting misalignment of the nozzle assembly 30 and die 36 as well as being compressible.

In operation a die 36 is lowered onto a nozzle assembly 30. In some instances the nozzle assembly 30 may be moved to the die 36 either by raising or moving laterally depending upon the arrangement of the die 36. When the nozzle assembly 30 contacts the die 36, pressure is applied so that the nozzle assembly 30 is compressed and the interface connector 68 and nozzle body 60 move the valve stem 54 downwards towards the base 44. This lowers the valve member 52 from the tapered shoulder 48 and the valve opens, permitting liquid metal alloy to flow through the nozzle assembly 30 into the die 36 through the interior space 51, the concentric passage 70, and the connection 38 in the die 36. Because of the flexibility of the sleeve 82, misalignment between the die 36 and the interface connector 66 is taken into account. The tapered tip 72 of the interface connector 68 moves laterally until it exactly matches the tapered shoulder 76 of the die 36. Because of the flexibility of the sleeve 82, considerable lateral movement is obtainable, while ensuring no liquid metal alloy escapes from the interface between the nozzle tip 72 and the tapered shoulder 76. Furthermore because of the deflective properties of the sleeve 82, variations in height or in direct distance between the base 44 and the die 36 can be taken into account because the sleeve 82 is sufficiently flexible to permit some deflection. Furthermore the relatively small size of the nozzle assembly permits it to fit in small spaces.

Figure 4:
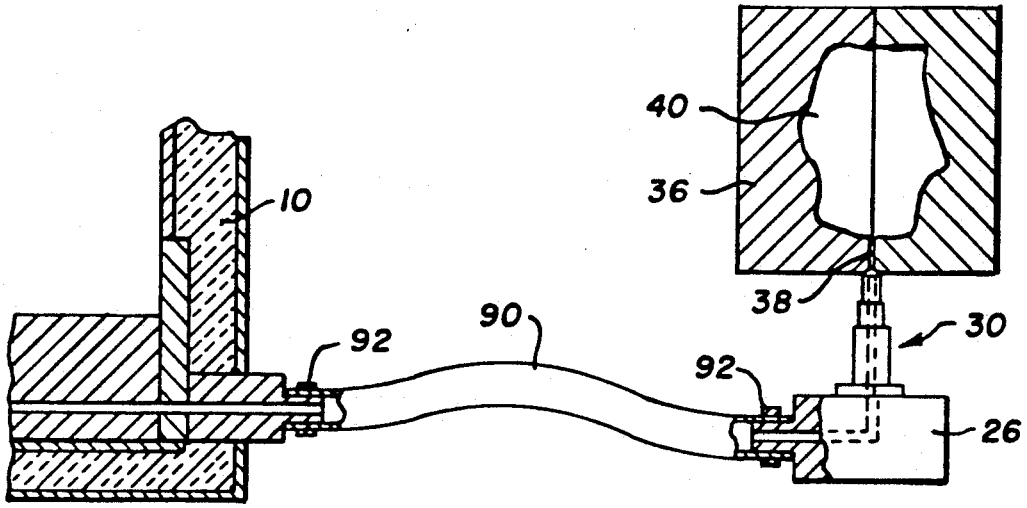
FIG. 4 is a partial schematic diagram of an apparatus for casting metal alloys having a flexible hose used as a transfer line.

Another embodiment shown in FIG. 4 illustrates a tank 10 connected to a manifold 26 by means of a flexible hose 90. Special clamps 92 are provided on each end of the hose 90 which is preferably made from a high temperature silicone rubber which is capable of handling the temperature and pressure of the molten metal alloy. Temperatures of the molten metal alloys used for low temperature melt out parts and encapsulation are generally not higher than 400° C., and pressures do not generally exceed 60 lbs. per sq. inch.

Figure 5:
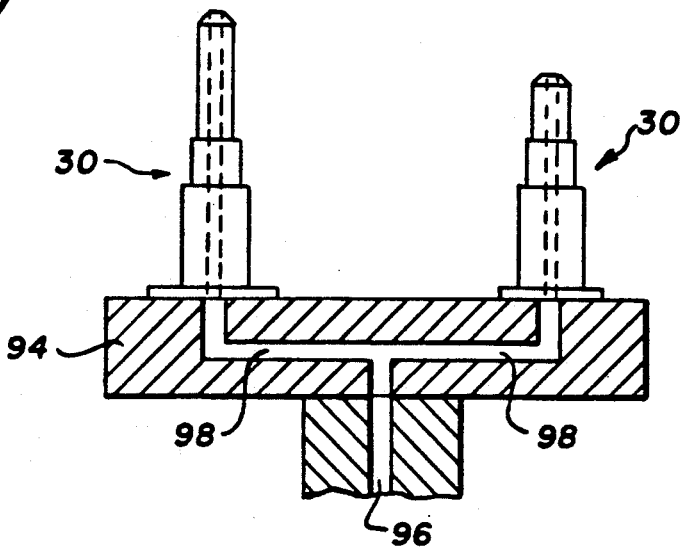
FIG. 5 is a partial sectional view showing a turntable with two nozzles thereon.

FIG. 5 illustrates another embodiment wherein two nozzle assemblies 30 are mounted on a turntable 94. Molten metal alloy from a single source flows through a channel 96 at the turntable axis and is divided into separate transfer lines 98 to the two nozzle assemblies 30. Whereas two nozzle assemblies are shown herein, it will be apparent to those skilled in the art that more than two nozzle assembly may be provided. As shown in the drawing, one nozzle assembly 30 is shown slightly higher than the other nozzle assembly 30. However this difference in height is taken into account by the adaptor 66 and interface connector 68 of the nozzle assemblies 30. The sleeve 82 may be compressed to adjust for the different heights of the dies 36 and still avoid spillage of liquid metal alloy.

Figure 6:
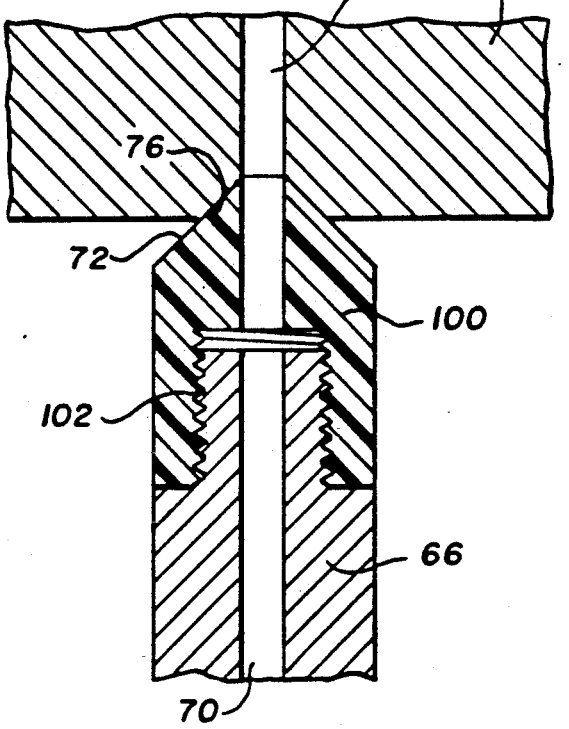
FIG. 6 is a partial sectional view showing an interface connector wherein the portion on the nozzle is made of a low heat transfer material.
Figure 7:
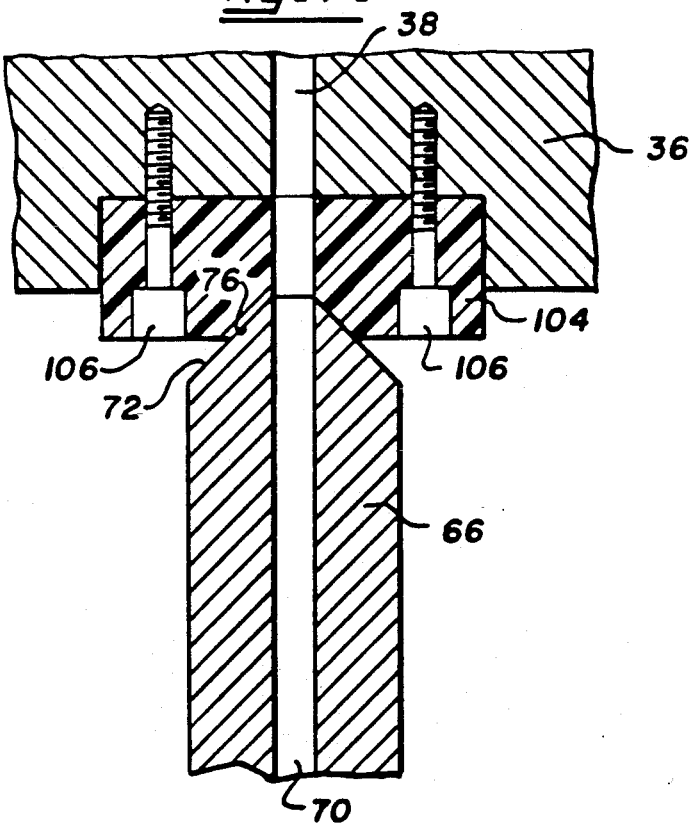
FIG. 7 is a partial sectional view showing an interface connector between a nozzle and a die in the form of an insert attached to the die.

FIGS. 6 and 7 illustrate another feature of the present invention wherein the interface connector 66 has an insert between the connector 66 and the die 36 made of a low heat transfer material. In the case of FIG. 6 a nozzle cap 100 is fitted onto the interface connector 66 by means of a screw thread 102. The nozzle cap 100 is preferably made out of a ceramic material, or alternatively, a high temperature plastic which avoids heat loss between the die 36 and the interface connector 66. This is particularly apparent when the full die 36 is removed from the nozzle assembly 30. In the case of FIG. 7 an insert 104 is attached to the die 36 by means of machine bolts 106. The nozzle tip 72 fits into the tapered shoulder 76 which is formed in the insert 104. The insert is preferably made out of a low heat transfer material such as ceramic material or high temperature plastic.

Various changes may be made to the embodiments shown herein without departing from the scope of the present invention which is limited only by the following claims.

The embodiments of the present invention in which an exclusive property or privilege is claimed are defined as follows:

1. In an apparatus for casting metal alloys with low melting temperatures, the improvement of a nozzle in a transfer line for joining to a die, comprising:

a base for connection to the transfer line;

valve means in the base to open and close the nozzle;

a nozzle body associated with the valve means, adapted to move relative to the base, and having spring means to retain the valve means closed;

sleeve means joining the base and the nozzle body to provide a passage for liquid metal alloy therethrough;

a connector positioned on the nozzle body to provide an interface connection between the transfer line and the die, and adapted to open the valve means when the connector interfaces with the die;

the sleeve means being formed of a flexible material capable of withstanding the temperature and the pressure of the liquid metal alloy to permit misalignment in the interface connection for the die.

2. The apparatus for casting metal alloys according to claim 1, wherein the valve means comprises a valve member to engage in an internal valve seat within the base, the valve member joined to a valve stem connected to the nozzle body, such that when the nozzle body moves towards the base, the valve member moves off the valve seat to open the valve means.

3. The apparatus for casting metal alloys according to claim 2 wherein the spring means comprises a coiled spring around the valve stem and within the sleeve means.

4. The apparatus for casting metal alloys according to claim 1 wherein the base is flanged and has attachment means for connection to a transfer line manifold.

5. The apparatus for casting metal alloys according to claim 1 wherein the sleeve means is made of a high temperature silicon rubber hose.

6. The apparatus for casting metal alloys according to claim 5 wherein the rubber hose is clamped to the base and to the nozzle body.

7. The apparatus for casting metal alloys according to claim 1 wherein the nozzle body has multiple apertures therethrough for the flow of the liquid metal alloy.

8. The apparatus for casting metal alloys according to claim 1 wherein the connector has a tapered tip adapted to fit within a tapered shoulder in the die, the combination of the tapered tip of the connector, and the tapered shoulder in the die preventing misalignment in the interface connection between the connector and the die.

9. The apparatus for casting metal alloys according to claim 1 wherein the interface connection between the connector and the die is made of a low heat transfer material.

10. The apparatus for casting metal alloys according to claim 9 wherein the interface connection is made of ceramic material.

11. The apparatus for casting metal alloys according to claim 9 wherein the interface connection is made of high temperature plastic.

12. The apparatus for casting metal alloys according to claim 9 wherein the interface connection is in the form of a nozzle cap attached to the connector.

13. The apparatus for casting metal alloys according to claim 9 wherein the interface connection is in the form of an insert attached to the die, and has a tapered shoulder therein to receive the connector.

14. The apparatus for casting metal alloys according to claim 1 including a heater means about the nozzle.

15. The apparatus for casting metal alloys according to claim 2 wherein the transfer line is formed of a high temperature flexible material for transferring liquid metal alloy to the nozzle.

16. In an apparatus for casting metal alloys with low melting temperatures, the improvement of a nozzle in a transfer line for joining to a die, comprising:

a base for connection to the transfer line, the base having an internal valve seat therein;

a valve member for the valve seat to close the nozzle, the valve member having a stem extending from and joining to a nozzle body, the nozzle body movable relative to the base to open the nozzle;

sleeve means surrounding the base and the nozzle body, permitting movement of the nozzle body relative to the base to open the nozzle;

spring means within the sleeve means to retain the nozzle closed; and a connector positioned on the nozzle body as an interface connection between the transfer line and the die, adapted to open the nozzle when the connector interfaces with the die;

the sleeve means being formed of a flexible material capable of withstanding the temperature and the pressure of the liquid metal alloy to permit misalignment in the interface connection for the die.

17. In an apparatus for casting metal alloys with low melting temperatures, the improvement of a nozzle in a transfer line for joining to a die, comprising:

a base for connection to the transfer line;

a nozzle body having at one end thereof a connector positioned to provide an interface connection between the transfer line and the die;

sleeve means extending between the base and the nozzle body to provide a passage for liquid metal alloy therethrough and formed of a flexible material capable of withstanding the temperature and the pressure of liquid metal alloy to permit misalignment between the nozzle body and the base;

valve means for controlling flow of the liquid metal alloy through and nozzle body; and spring means in the sleeve means to retain the valve means closed, the valve means adapted to open when the nozzle body moves towards the base.

18. A nozzle for use in an apparatus for casting metal alloys including a molten metal alloy source, a die, and a transfer line for delivering a molten metal alloy from the source to the die, said nozzle comprising:

a base for connection to the transfer line;

a nozzle body spaced from said base and having opposite ends;

a connector secured at one of said opposite ends for connecting said nozzle body to the die;

sleeve means extending between the other of said opposite ends of said nozzle body and said base and defining a passage for the molten alloy therethrough, said sleeve means being formed of a flexible material capable of withstanding the temperature and the pressure of liquid metal alloy to permit misalignment of said nozzle body relative to said base;

valve means for controlling flow of the molten metal alloy from said base into said nozzle body; and spring means located within said sleeve means for biasing said valve means to a closed position thereof in which said valve means blocks the flow of the molten metal alloy through said nozzle body, said valve means moving to an open position thereof in which the molten metal alloy flows through said nozzle body in response to movement of said nozzle body toward said base which takes place upon connection of said connector with the die.

19. In a method of casting metal alloys with low melting temperatures, wherein liquid metal alloy flows through a transfer line into a movable die, the improvement comprising the steps of:

providing a nozzle having valve means therein and sleeve means formed of flexible component that permits lateral and direct misalignment when the nozzle interfaces with the die; and feeding liquid metal alloy to the nozzle, the valve means in the nozzle being closed when the nozzle does not interface with the die, and open when the nozzle interfaces with the die.

20. The method of casting metal alloys according to claim 19 including the step of heating the nozzle to retain the metal alloy in the nozzle in a liquid state.

21. The method of casting metal alloys according to claim 19 wherein at least two nozzles are supplied from one transfer line, and including the step of permitting varying amounts of deflection of the nozzles to interface with different dies.

* * * * *